US005245821A

United States Patent [19]

Thomas, Jr. et al.

[11] Patent Number: 5,245,821

[45] Date of Patent: Sep. 21, 1993

[54] STATOR TO ROTOR FLOW INDUCER

[75] Inventors: Theodore T. Thomas, Jr., Loveland; Harold P. Rieck, Jr., West Chester, both of Ohio

[73] Assignee: General Electric Company, Cincinnati, Ohio

[21] Appl. No.: 779,753

[22] Filed: Oct. 21, 1991

[51] Int. Cl.[5] ..... F02C 3/00

[52] U.S. Cl. ..... 60/39.75; 415/116; 415/117

[58] Field of Search ..... 60/39.75; 415/116, 117

[56] References Cited

U.S. PATENT DOCUMENTS

| | | | |
|---|---|---|---|
| 2,988,325 | 6/1961 | Dawson | 253/39.15 |
| 3,565,545 | 2/1971 | Bobo et al. | 416/90 |
| 3,814,539 | 6/1974 | Klompas | 416/95 |
| 3,826,084 | 7/1974 | Branstrom | 60/39.66 |
| 3,980,411 | 9/1976 | Crow | 415/1 |
| 4,178,129 | 12/1979 | Jenkinson | 416/95 |
| 4,236,869 | 12/1980 | Laurello | 416/95 |
| 4,425,079 | 1/1984 | Speak et al. | 415/139 |
| 4,435,123 | 3/1984 | Levine | 416/95 |
| 4,730,978 | 3/1988 | Baran, Jr. | 415/115 |
| 4,882,902 | 11/1989 | Reigel et al. | 60/39.75 |

FOREIGN PATENT DOCUMENTS 1284858 4/1971 United Kingdom .

*Primary Examiner*—Richard A. Bertsch
*Assistant Examiner*—W. J. Wicker
*Attorney, Agent, or Firm*—Jerome C. Squillaro

[57] ABSTRACT

An aerodynamically efficient flow transfer device having a means to transfer flow from a static element to a rotor element such that the end of the exit flow is substantially parallel to an exit plane that is perpendicular to the axis of rotation of the rotor and substantially tangential to the operational rotational direction of the rotor. The preferred embodiment provides a cooling air flow transfer apparatus, between a stationary compressor and turbine rotor, having an inducer which includes cooling air flow holes or passages that are acutely angled in a tangential manner to the rotational direction of the rotor. The passages include a cylindrical section leading to a downstream flared outlet in the form of an open channel that has a back wall with a portion that curves to be parallel to the exit plane of the inducer at the channel's end.

13 Claims, 3 Drawing Sheets

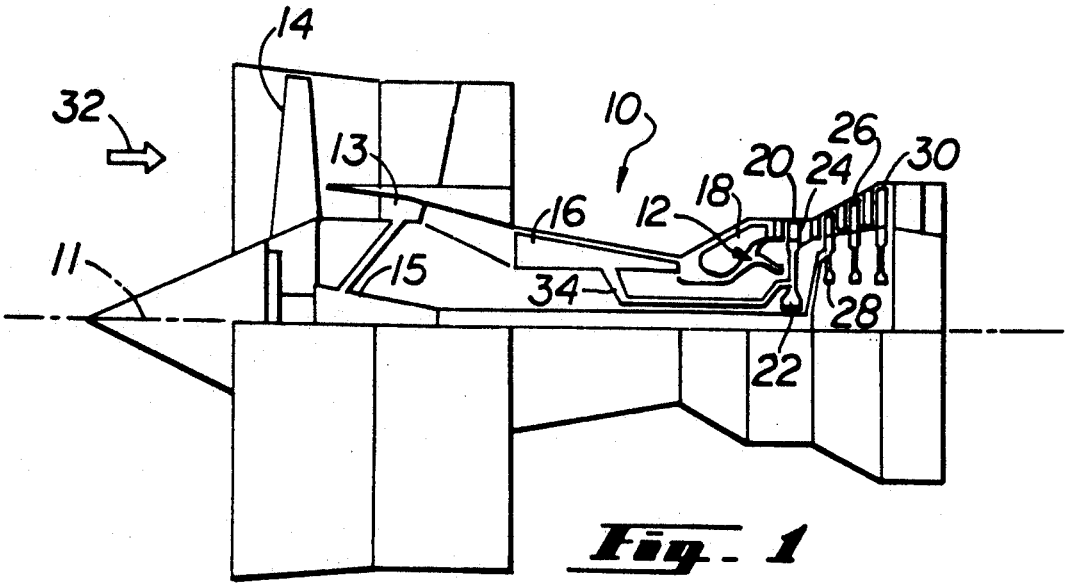
Fig. 1
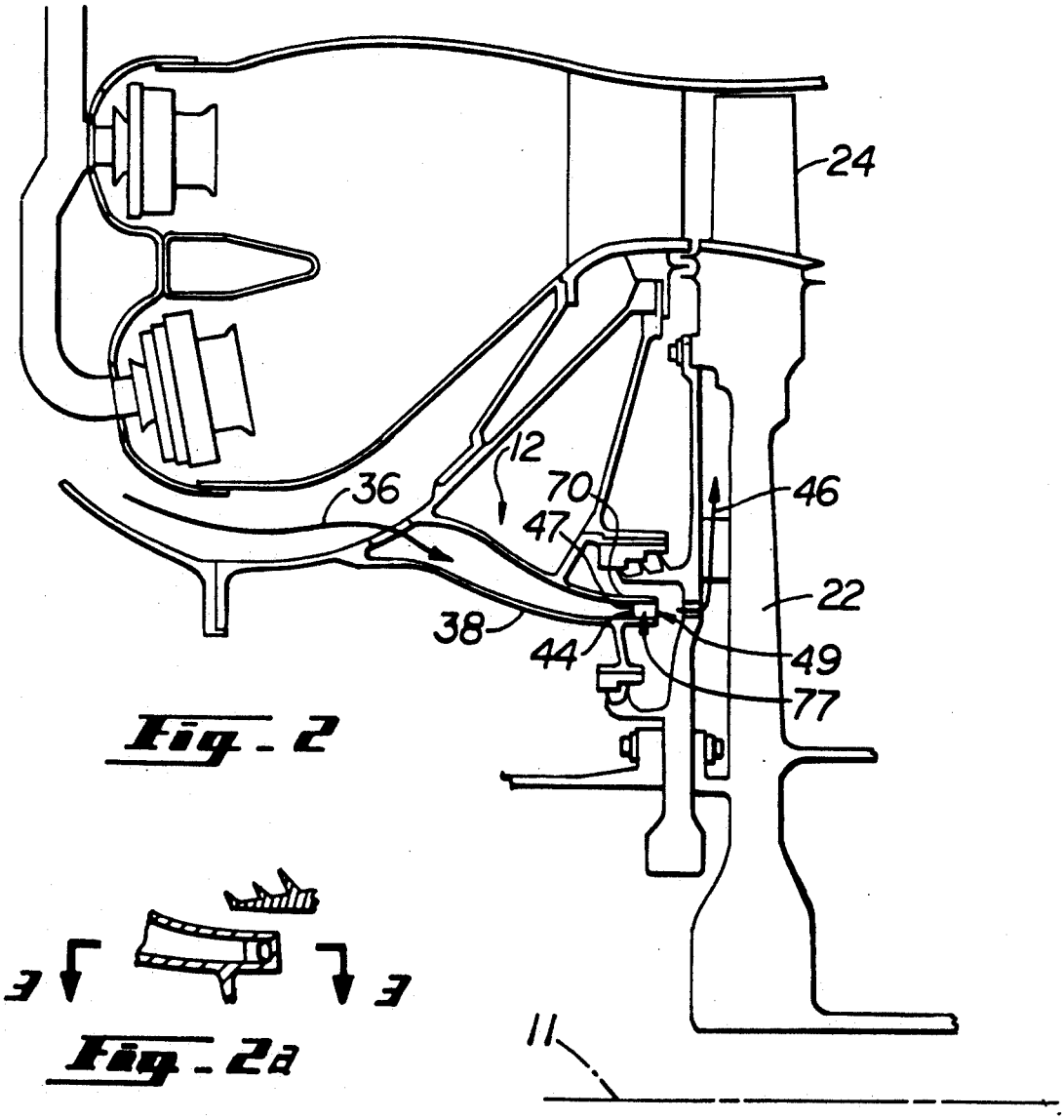
Fig. 2
Fig. 2a

X
wi
216
hi
212
44'

210
hc
120
98
100
200
77
110
102
D
124
d
C
130
E
B'

STATOR TO ROTOR FLOW INDUCER

BACKGROUND OF THE INVENTION

1. Field of the Invention

The invention relates to gas turbine engine turbine disk and blade cooling and in particular to inducers used to tangentially inject cooling air from a static section of the engine to a section of the engine's rotor.

2. Description of Related Art

Gas turbine engine's efficiency and specific fuel consumption are greatly improved by employing higher temperature turbine flows. In order to operate at higher turbine temperatures, turbine rotors and their blades are designed to use cooling air gathered and transferred from static portions of the engine. In order to efficiently transfer the cooling air, tangential flow inducers have been designed, usually in the form of a circumferentially disposed array of nozzles to accelerate and turn the cooling flow so as to tangentially inject the cooling flow into rotating rotors at a rotational or tangential speed and direction substantially equal to that of the rotor.

An example of such an inducer may be found in U.S. Pat. No. 4,882,902 to James R. Reigel et al., entitled "Turbine Cooling Air Transferring Apparatus", assigned to the same assignee, and incorporated herein by reference. Reigel incorporates circumferentially curved radially extending vanes forming nozzle type cooling air flow passages therebetween to accelerate and turn the cooling flow. Inducer nozzles having circular cross-sections are shown in U.S. Pat. No. 4,425,079 to Trevor H. Speak et al., entitled "Air Sealing for Turbomachines", and in U.S. Pat. No. 3,980,411 to David Edward Crow, entitled "Aerodynamic Seal for a Rotary Machine".

The inducers in the prior art all inject the cooling air flow in a direction that is tangent to the operational direction of rotation of the rotor. The velocity vector of the flow also has an axial component that causes flow losses at the transfer point, particularly along the edge of the exit hole.

The velocity distribution of the accelerated flow produces a substantially jet like flow from each of the inducer nozzles, creating an annular, series of these jets. Cooling flow separation may occur between the jets which result in high flow losses and lowers the operating efficiency of the engine.

The separated air flow problem of prior art inducers is particularly acute for inducers having small radially extending inducer heights, as measured from the engine centerline. Such designs are very useful in engines having low cooling air mass flow rates through the inducers. Cylindrical cooling air flow holes or passages provide a very aerodynamically efficient means for tangential injection of the cooling air into the rotor; however, cylindrical air flow passages, because of their well formed and discrete jets, produce separated flow regions between the cooling air injection jets which is undesirable as explained above.

SUMMARY OF THE INVENTION

The present invention provides a method for aerodynamically efficient tangential injection of cooling air into a rotor using an efficient cylindrical hole while avoiding separated flow regions between cooling air injection jets.

The preferred embodiment of the present invention provides an aerodynamically efficient cooling air flow inducer that is generally disposed in an annular fashion about an inducer centerline that coincides with a gas turbine engine centerline. The inducer provides a cooling air passage. It has a cylindrical portion and a downstream flared outlet to provide a means for effecting a continuous annular flow of cooling air across the exit plane of the inducer, instead of a series of inducer exit flows having discrete jet like velocity profiles with separated flow regions therebetween.

The preferred embodiment of the present invention provides a circumferentially disposed plurality of cooling air flow passages. The passages include a cylindrical cooling section leading to a flared outlet in the form of an open channel, having a height substantially equal to the diameter of the cylindrical section, forming the exit of the inducer cooling air flow passage. The exit is formed along a generally flat annular planar exit surface of the inducer wherein the plane and its surface is are oriented at right angles to the inducer centerline and define the inducer's exit plane.

The cylindrical cooling air flow passage defined about a hole centerline is angled at a sharply acute angle with respect to the exit plane and is substantially tangential with respect to the engine rotor's rotational direction. Cooling air flow passages preferably include, in serial flow relationship, a flared inlet, a conical section for accelerating the cooling flow, and a cylindrical section disposed about the hole centerline to provide good flow definition. The cylindrical section leads to an open channel portion, that breaks the exit plane and includes a transition section, that transits from a circular to a rectangular cross-section about a transition centerline, that coincides with inducer cooling hole centerline, and a rectangular cross-sectional section.

The rectangular cross-section section of the open channel is curved so that its rear wall is tangent to the end of the transition section at its upstream end and nearly parallel at its downstream end to the exit plane of the inducer. In the preferred embodiment, the open channel's curve is generally circular in its planar projection, has a radius of curvature about an axis extending perpendicularly from the inducer centerline to gently redirect the flow from its angle to the exit plane to be essentially parallel to the exit plane and tangential to the rotational direction of the rotor. The curve thereby forms a continuous annular flow of cooling air without separated flow regions between the exits of the cooling air flow passages.

The inducer passage of the present invention has the advantage of being aerodynamically efficient. The passage provides a cooling flow that has an inducer exit velocity vector that is highly tangent with respect to the rotational direction of the rotor. This provides a very efficient cooling air flow transfer from the static portion of the gas turbine engine to the engine rotor with a minimum of flow and energy losses.

An alternative embodiment provides an annular array of nozzle vanes arranged to form converging cooling air flow passages between adjacent vanes. It gathers and accelerates the cooling air flow to a speed substantially to that of the tangential velocity of the rotor at the point of the cooling flow transfer. A cylindrical cooling air flow section leads from the passage between adjacent vanes at a point where the passage is rectangular and has a height substantially equal to the diameter of the cylindrical section. The cooling air passages end in a flared outlet formed from an open channel passage that includes a circular to rectangular transition section. The rectangular cross-sectional section of the open channel is formed in the surface of the axially rear vane. It is curved so that its rear wall is tangent to the end of the transition section at its upstream end and nearly parallel at its downstream end to the exit plane of the inducer.

BRIEF DESCRIPTION OF THE DRAWINGS

The foregoing aspects and other features of the invention are explained in the following description, taken in connection with the accompanying drawing where:

FIG. 1 is a cross-section of a gas turbine engine.

FIGS. 2 and 2*a* are a cross-sectional view of the portion of engine shown in FIG. 1 illustrating a cooling air transferring apparatus having an inducer in accordance with the present invention.

DETAILED DESCRIPTION OF THE INVENTION

Figure 3:
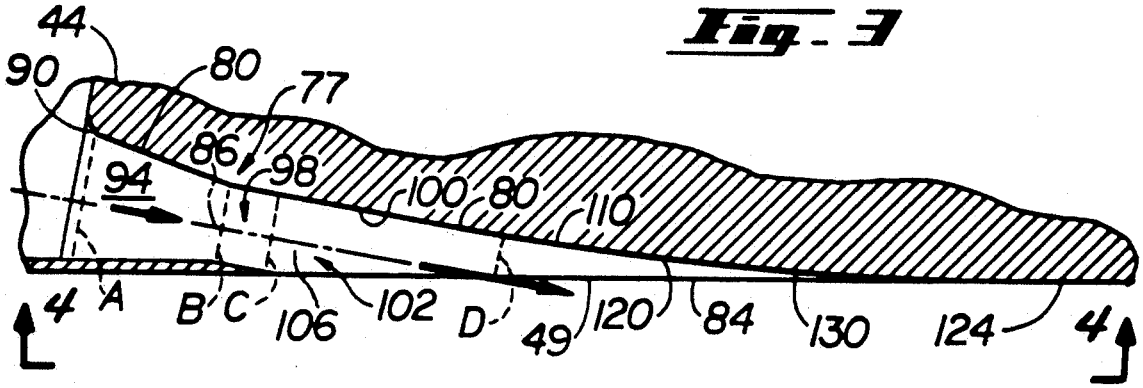
FIG. 3 is a top planform cross-sectional view of a cooling air flow passage in the inducer in FIG. 2 in accordance with the preferred embodiment of the present invention.

Illustrated in FIG. 1 is an axial flow gas turbine engine shown generally at 10, including a cooling air transferring apparatus generally located at 12, according to one embodiment of the present invention. Engine 10 includes in serial flow relationship along an engine centerline 11, a fan 14, a low pressure compressor 13, a core engine compressor 16, a combustor 18, a high pressure turbine 20 including a high pressure turbine disk 22 having a plurality of circumferentially spaced high pressure turbine blades 24 extending radially outwardly therefrom, and a low pressure turbine 26 including low pressure turbine disks 28 having a plurality of circumferentially spaced low pressure turbine blades 30 extending radially outwardly therefrom.

In conventional operation, inlet air 32 is pressurized by fan 14, low pressure compressor 13, and core engine compressor 16. A major portion of the inlet air 32 is then suitably channeled into the combustor 18. It is mixed with fuel for generating relatively high pressure combustion gases which flow to the high pressure turbine 20 for providing power to high compressor 16 through an interconnecting high pressure shaft 34. The combustion gases then pass through a low pressure turbine 26 for providing power to low pressure compressor 13 and fan 14 through an interconnecting low pressure shaft 15 and are then discharged from engine 10.

A portion of the pressurized inlet air 32, that is discharged from high pressure compressor 16, is used for providing pressurized cooling air 36, shown in FIG. 2, for cooling the hot rotor components that are disposed in the engine flowpath containing hot combustion discharge gases. Referring to FIG. 2, cooling air 36 is channeled to the cooling air transferring apparatus 12 by an annular inner duct 38 disposed about an inducer centerline that in the preferred embodiment coincides with engine centerline 11.

The air transferring apparatus includes an annular inducer means 44, according to the preferred embodiment of the present invention, and shown in greater details in FIGS. 3, 4, 5, 6, and 7. It is effective for accelerating and channeling cooling air 36 in a direction substantially parallel and tangential to the rational direction of high pressure turbine disk 22 and into radial cooling air flowpath 46 in high pressure turbine disk 22 that eventually leads to high pressure turbine blades 24. Annular inducer means 44 is depicted as an annular array of inducers 70, preferably cast, but which may be a fabricated or made from an assembly, having a generally annular inlet 47 and a generally annular outlet 49 with cooling air passages 77 disposed therebetween.

Figure 4:
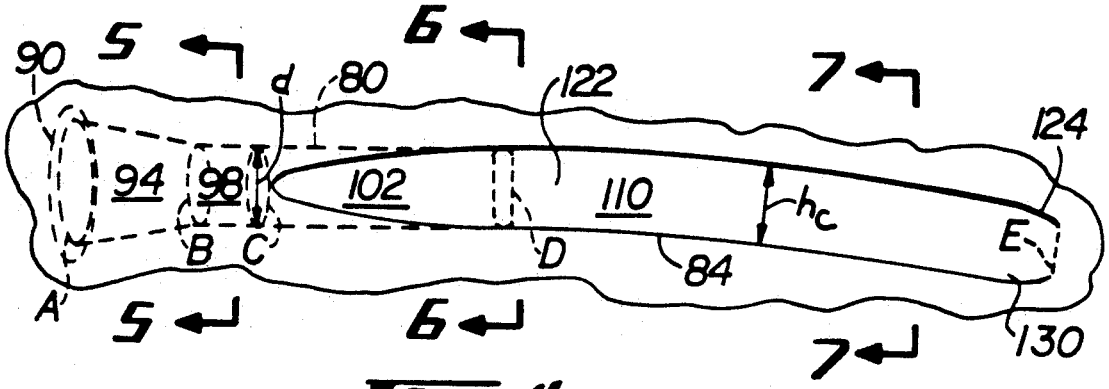
FIG. 4 is an aft looking forward cross-sectional view of the cooling air flow passage in the inducer in FIG. 3 in accordance with the preferred embodiment of the present invention.
Figure 5:
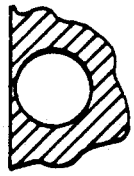
FIGS. 5, 6, and 7 are cross-sections of the cooling air flow passage in the inducer in FIG. 4 taken at different circumferential locations as indicated in FIG. 4.

Annular inducer means 44, illustrated in FIGS. 3 and 4, includes a cooling air passage generally shown at 77 having a cooling hole 80 in fluid communication with generally a flared circumferentially extending cooling air passage outlet 84, preferably in the form of an open channel 100. Cooling air hole 80 has a hole centerline 86 angled with respect to the inducer centerline and includes, in serial flow relationship, a flared inlet 90, a conical section 94 for accelerating the cooling flow between stations A and B (stations indicated by dotted lines), and a cylindrical section 98 having a circular cross-section, as briefly shown in FIG. 5, to provide good flow definition between stations B and C. Channel 100 is open at its intersection with an exit plane 130 at inducer outlet 49 and has a channel height $h_c$ equal to the diameter d of cylindrical section 98.

Figure 6:
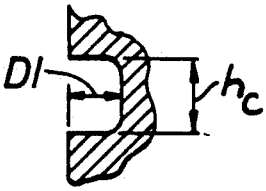

Channel 100 includes a transition section 102 between stations C and D, that transits from a circular to a rectangular cross-section about a transition centerline 106, that extends from inducer cooling hole centerline 86 defining a rear wall 120, and a rectangular cross-sectional section 110, having a rectangular cross-section, as illustrated in FIG. 6, that extends from station D to the end of the cooling air passage at E.

Figure 7:
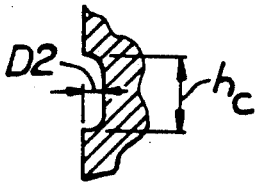

Rectangular cross-section section 110 of the channel 100 is curved so that its rear wall 120 is tangent at its upstream end 122 at station D to transition section 102, and substantially parallel at its downstream end 124 to the exit plane 130 of cooling air passage 77 indicated by the smaller depth D2 of the channel at 7—7 than the depth D1 at 6—6, as illustrated in FIGS. 7 and 6, respectively. Rectangular cross-section section 110 provides a means to turn inducer cooling air flow to a direction that is both tangent to the direction of the rotor to which it is being flowed into and parallel to a plane perpendicular to the engine and inducer centerline, thereby providing a highly aerodynamically efficient inducer which incurs minimum of flow loss.

Figure 8:
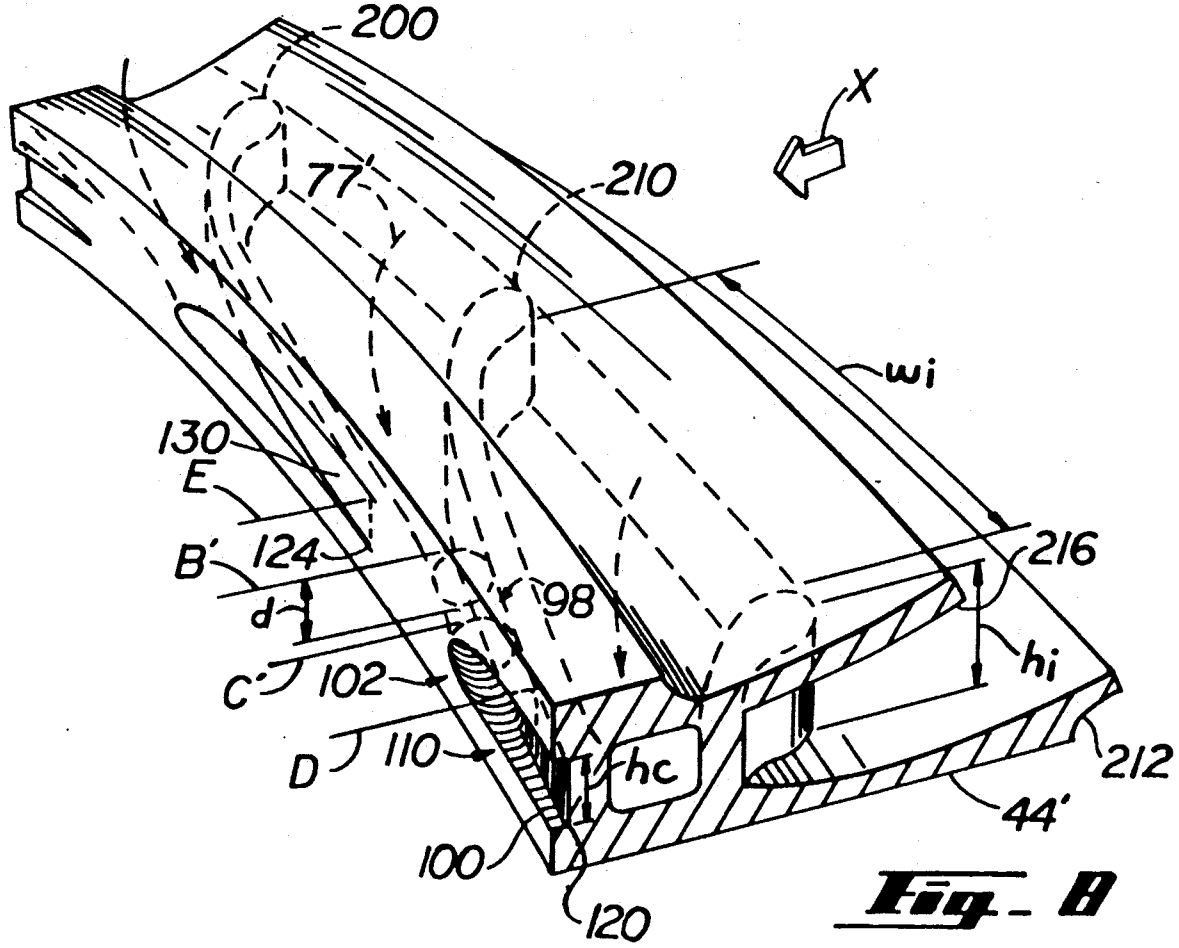
FIG. 8 is a cut-away perspective view of the portion of engine shown in FIG. 1 illustrating a cooling air transferring apparatus having an inducer in accordance with an alternate embodiment of the present invention.

An alternate embodiment of the annular inducer means 44, illustrated in FIG. 2, is a foil type inducer generally shown at 44' in FIG. 8. Foil inducer 44' includes an annular array of cooling air passages generally shown at 77' between adjacent foils 200 and 210 which are radially disposed between annular inner and outer shrouds 212 and 216, respectively. Outer shroud 216 is angled in the axial direction, indicated by arrow X, with respect to inner shroud 212 so that cooling passage 77' converges in height from an inlet height $h_i$ in the downstream direction of passage 77'. The width of passage 77′ or the distance between adjacent foils 200 and 210, also converges in the downstream direction of passage 77′ from an inlet width $w_i$ so that at one point both the height and width of passage are equal.

This point corresponds to station B′ where a cylindrical cooling hole portion 98 having a diameter d′ is formed, preferably by drilling between the foils and shrouds defining passage 77′. Cylindrical cooling hole portion 98 ends at station C′ where a channel 100 of passage 77′ begins just as in the preferred embodiment, described above and illustrated in FIGS. 3–7.

Channel 100 includes a transition section 102 between stations C′ and D′ that transits from a circular to a rectangular cross-section. Channel 100 includes a rear wall 120 preferably formed in foil 210 and a rectangular cross-sectional section 110 having a rectangular cross-section, as illustrated in FIG. 6, that extends from station D to the end of the cooling air passage at E.

As in the embodiment of FIGS. 3 and 4, the alternate embodiment illustrated in FIG. 8 includes an annularly disposed fared outlet in the form of a channel 100 that includes a rectangular cross-sectional section 110. Still referring to FIG. 8, rectangular cross-section section 110 is curved so that its rear wall is tangent at its upstream end at station D to transition section 102, and substantially parallel at its downstream end 124 at station E to exit plane 130 of cooling air passage 77′.

While the embodiments of the present invention presented herein have been described fully in order to explain its principles, it is understood that various modifications or alterations may be made to the described embodiments without departing from the scope of the invention as set forth in the appended claims.

We claim:

1. A flow transfer apparatus for transferring a flow from a static element to a rotor element, said apparatus comprising:

an inducer including at least one flow passage having in serial flow relationship;

a flow accelerating section to accelerate the flow, said flow accelerating means attached to the static element, a cylindrical section at an acute angle with respect to a plane perpendicular to the axis of rotation of the rotor, a downstream flared outlet for said passage generally flared in the rotational direction of the rotor, and wherein said flared outlet includes an open channel downstream of said cylindrical section, said channel having a back wall that ends substantially parallel to a plane perpendicular to a centerline of the rotor.

2. A flow transfer apparatus as claimed in claim 1 wherein said channel has a generally rectangular cross-section.

3. A flow transfer apparatus as claimed in claim 2 wherein said flow accelerating section includes a downstream converging conical section of said flow passage.

4. A flow transfer apparatus as claimed in claim 3 wherein said channel includes a transition section from a circular cross-section to a rectangular cross-section.

5. A flow transfer apparatus as claimed in claim 3 wherein said conical section of said flow passage includes a flared inlet.

6. A flow transfer apparatus as claimed in claim 2 wherein said inducer means further comprises:

radially spaced apart converging annular inner and outer shrouds and a circumferential array of foils radially deposed between said shrouds and said cooling air flow passages are formed between adjacent ones of said foils.

7. A flow transfer apparatus as claimed in claim 6 wherein said flow accelerating section is a first section of said passage, said cylindrical section is formed between said adjacent foils and shrouds.

8. A flow transfer apparatus as claimed in claim 7 wherein said flow accelerating section connects to said cylindrical section at a point where said accelerating section has a substantially square cross-section and sides that are substantially equal to the diameter of said cylindrical section.

9. A gas turbine engine cooling air transferring means for transferring cooling flow from the engine's compressor to a turbine disk of the engine's rotor, wherein the cooling air transferring means comprises in combination:

an inducer means effective for channeling the cooling air in a direction substantially tangential to said turbine disk and parallel to a plane perpendicular to a centerline of the turbine disk;

said inducer means including at least one flow passage having in serial flow relationship;

a flow accelerating section to accelerate the flow, a cylindrical tangential flow means to tangentially transfer the flow to the rotor in a direction substantially equal to the operational direction of rotation of the rotor, and a parallel flow transfer means to inject at least a section of the flow into the rotor in a direction that is substantially parallel to a said plane wherein said parallel flow transfer means includes a channel at an end of an outlet to said flow passage having a back wall that ends substantially parallel to a plane perpendicular to a centerline of the rotor.

10. A gas turbine engine cooling air transferring means as claimed in claim 9 wherein:

said flow accelerating section comprises a hole having a downstream converging conical hole section leading to cylindrical hole section, said channel has a rectangular cross-section, and said tangential flow means includes a hole centerline through at least said conical and cylindrical sections, said a centerline at an acute angle with respect to said plane.

11. A gas turbine engine cooling air transferring means as claimed in claim 10 further comprising a circular to rectangular cross-section transition section of said flow passage between said cylindrical section and said channel.

12. A gas turbine engine cooling air transferring means for transferring cooling flow from the engine's compressor to a turbine disk of the engine's rotor, wherein the cooling air transferring means comprises in combination:

an inducer means having radially spaced apart converging annular inner and outer shrouds and a circumferentially disposed array of foils radially disposed between said shrouds;

cooling air flow passages formed between adjacent ones of said foils effective for flowing the cooling air in a direction substantially tangential to the turbine disk and parallel to a plane perpendicular to the rotational axis of the turbine disk;

said cooling air flow passage having in serial flow relationship;

a flow accelerating section to accelerate the flow, a cylindrical tangential flow means to tangentially transfer the flow to the rotor in a direction substantially equal to the operational direction of rotation of the rotor, and a parallel flow transfer means to inject at least a section of the flow into the rotor in a direction that is substantially parallel to a said plane, said parallel flow transfer means includes a channel at an end of an outlet to said flow passage having a back wall that ends substantially parallel to a plane perpendicular to a centerline of the rotor, and said flow accelerating section comprises a hole having a downstream converging conical hole section leading to cylindrical hole section, said channel has a rectangular cross-section, and said tangential flow means includes a hole centerline through at least said conical and cylindrical sections, said a centerline at an acute angle with respect to said plane.

13. A gas turbine engine cooling air transfer means as claimed in claim 15 further comprising a circular to rectangular cross-section transition section of said flow passage between said cylindrical section and said channel.

* * * * *